United States Patent [19]

Betsuda et al.

[11] 4,285,892

[45] Aug. 25, 1981

[54] PROCESS FOR TAPERING SYNTHETIC FIBERS AT THE END PORTION THEREOF

[75] Inventors: Yasuhiro Betsuda, Fujisawa; Yoshio Taguchi, Chibi; Yasuo Takashashi, Chigasaki, all of Japan

[73] Assignee: Shinwa Seisakusho Co., Ltd., Kanagawa, Japan

[21] Appl. No.: 123,617

[22] Filed: Feb. 22, 1980

[30] Foreign Application Priority Data

Mar. 1, 1979 [JP] Japan ..... 23619/79

[51] Int. Cl.[3] ..... B06B 3/00

[52] U.S. Cl. ..... 264/23; 15/159 A; 264/162; 264/341

[58] Field of Search ..... 428/399; 264/162, 23, 264/341, 167; 15/159 A; 156/625

[56] References Cited

U.S. PATENT DOCUMENTS

| | | | |
|---|---|---|---|
| 3,524,447 | 8/1970 | Evans | 264/341 |
| 3,554,880 | 1/1971 | Jenkia | 156/625 |

FOREIGN PATENT DOCUMENTS

| | | | |
|---|---|---|---|
| 49-47618 | 5/1974 | Japan | 428/399 |
| 1400028 | 7/1975 | United Kingdom | 264/343 |
| 334196 | 4/1972 | U.S.S.R. | 156/625 |

*Primary Examiner*—Jay H. Woo

*Attorney, Agent, or Firm*—Jordan and Hamburg

[57] ABSTRACT

A process for tapering synthetic fibers at the end portion thereof comprising the steps of inserting synthetic fibers into a supersonic vibration-given etching liquid to an extent that only the end portion of the fibers is immersed therein, withdrawing the fibers from the supersonic vibration-given etching liquid and then washing the treated fibers in a supersonic vibration-given washing liquid, the insertion and withdrawal being alternately repeated each at a predetermined velocity. In one embodiment, the etching liquid has abrasive particles suspended therein or an abrasive brush provided therein.

21 Claims, 6 Drawing Figures

PROCESS FOR TAPERING SYNTHETIC FIBERS AT THE END PORTION THEREOF

This invention relates to a process for tapering synthetic fibers at the end portion thereof. More particularly, it relates to such a process comprising repeating slow immersion of synthetic fibers into, and slow withdrawal thereof from, an etching liquid while giving supersonic vibration thereto thereby to taper the synthetic fibers at the end portion thereof.

Unlike animal hair having its end tapered, synthetic fibers are not tapered at the end portion thereof but are cylindrical in shape along all the length thereof. There have thus been proposed various processes for tapering synthetic fibers at the end portion in order to adapt them to be used as paintbrushes, writing brushes, dressing brushes and the like for coating paints and dressing powders. The processes so proposed include a process comprising hot drawing synthetic fibers to make one end portion thereof tapered, a process comprising grinding the end portion of synthetic fibers with a grinder to make them mechanically tapered and a process comprising etching or dissolving one end portion of synthetic fibers in a solution of a chemical agent capable of attacking the fibers. However, the process for hot drawing does not attain complete tapering of one end portion of synthetic fibers since the hot drawn fibers are cooled to be solidified and then cut, and the process for grinding is disadvantageous in that it provides synthetic fibers which are tapered at the end portion but are not smooth-finished at the surface.

Japanese Patent Gazette No. 21821/77 discloses a process comprising both treating fibers with a chemical agent and grinding them, Japanese Patent Gazette No. 40195/75 discloses a process comprising immersing a part of fibers in a chemical agent solution, wetting the upper portion of the fibers above the liquid level with the chemical agent solution by the use of capillary action and raising said solution in temperature to cause a temperature gradient in the solution with which said upper portion of the fibers is wetted and to differentiate the velocity of etching the said wetted upper portion along the length thereof, thereby to tapering the fibers at the upper portion, and Japanese Patent Gazette No. 29239/76 discloses a process comprising jetting a chemical agent solution toward one end portion of fibers in the direction perpendicular thereto. The above process comprising both hot drawing and grinding, and the process comprising jetting the chemical agent solution are disadvantageous in that a frictional force is applied to the fibers perpendicularly thereto, the fibers are bent by the force and they are therefore apt to cause plastic deformation whereby the chemical agent-treated portion of the fibers tend to be bent. Further, the process comprising using the capillary action and temperature difference is also disadvantageous in that the treated fibers take a long time to be washed and they are apt to stick to one another in groups and solidify as they are since the chemical agent solution for dissolving the upper portion of the fibers is not replaced with a new one.

An object of this invention is to provide a process for producing in a short time tapered synthetic fibers having a desired taper outline which eliminate the aforesaid disadvantages such as the tendency to be bent and the aptitude to stick to each other.

In one aspect of this invention, synthetic fibers in a bundle are inserted through one end portion thereof in, and withdrawn from, an etching liquid capable of etching or dissolving the synthetic fibers while giving a supersonic vibration to the etching liquid whereby the fibers are etched or dissolved at the end portion, the immersion and withdrawal being repeated at a predetermined velocity as required; the treated fibers in a bundle are then immersed in a washing liquid for washing away the etching liquid carried with the fibers while giving supersonic vibration to the washing liquid, thereby to produce synthetic fibers with one end portion thereof tapered.

In another aspect of this invention, the aforesaid procedure is followed except that abrasive particles are suspended in the etching liquid or an abrasive brush or other slidably frictionizing material is provided therein whereby, in addition to being etched, the synthetic fibers are slidably frictionized at the surface along the length thereof by their up-and-down motion caused by their repeated insertion into and withdrawal from the etching liquid.

The reason why the supersonic vibration is given to the etching liquid in the tapering of the end portion of bundled synthetic fibers, is that the surface texture of synthetic fibers is attacked by the supersonic vibration of the etching liquid to promote the etching or dissolution of the fibers, diffuse the portion of the etching liquid in which the fibers are dissolved in a high concentration and agitate the whole of the etching liquid due to the convection caused by said diffusion. In this case, the resulting tapered synthetic fibers will not acquire a tendency to be unnecessarily bent.

As it is difficult that supersonic waves promulgate from within a liquid into air, the velocity of etching or dissolving synthetic fibers during their residence in the etching liquid is different from that during their residence in the air. Thus, the synthetic fibers may be tapered at the end portion by inserting them at a predetermined velocity into the supersonically vibrated etching liquid and withdrawing the same at a predetermined velocity therefrom, the insertion and withdrawal being alternately repeated as required. The outline of taper may be varied as desired by adjusting the velocities of the insertion and withdrawal.

The reason why the supersonic vibration is given to the washing liquid is that the supersonic vibration may be promulgated even into very narrow spaces surrounded by the fibers to attack the etching liquid-containing fibers and diffuse the etching liquid remaining in the fibers whereby complete washing and etching are attained. To generate the supersonic vibration (sinc wave, pulse wave), a frequency of 10-50 KHz may preferably be used.

As mentioned in the second aspect of this invention, abrasive particles having sonic properties (such as density) and inertia different from those of the etching liquid and also having chemical resistance thereto, or an abrasive brush composed of slender wire may be present as a slidably frictionizing material below the liquid level of the etching liquid in order to promote the etching effect by the supersonic vibration, accelerate the diffusion and agitation of the etching liquid and control the finish of etching effectively.

This invention will be explained in more detail by reference to the accompanying drawing in which.

Figure 1:
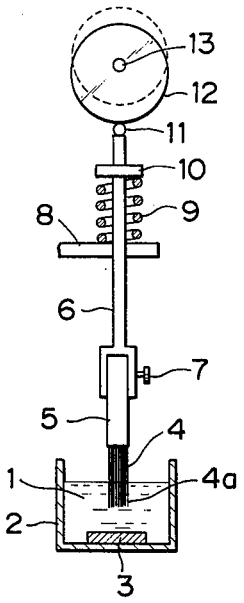
FIG. 1 is a diagrammatic view of an embodiment of an etching apparatus according to this invention.
Figure 2:
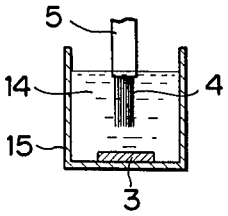
FIG. 2 is a diagrammatic view of an embodiment of a washing apparatus according to this invention.

Referring now to FIGS. 1 and 2, numeral 1 indicates an etching liquid for etching or dissolving synthetic fibers, numeral 2 an etching tank, numeral 3 a supersonic vibrator provided at the bottom of the etching tank 2, numeral 4 synthetic fibers in a bundle, numeral 4*a* the end portion of the bundled fibers 4 to be tapered, numeral 5 a brush holder fitted with the bundled synthetic fibers 4, numeral 6 a rod for supporting the brush holder 5, and numeral 7 a screw for fitting the brush holder to the rod. Numeral 8 is a supporting table for supporting the rod 6 by means of a spring 9 secured at the upper end to a stopper 10. The rod 6 is provided at the upper end with a roller 11 which is rotatably contacted with a cam 12 (For example, dia., 14 mm; eccentricity, 4 mm; rotation speed, 12 r.p.m.) rotatable around the rotation axis 13. By the gentle rotation of the cam 12, the bundled fibers 4 descend to be inserted into the etching liquid 1 and then ascend to be withdrawn therefrom, the decension and ascension being alternately repeated as required.

Referring to FIG. 1, there will be explained a process for tapering the end of the bundled synthetic fibers 4 fitted to the brush holder 5. The brush holder 5 with the bundled fibers fitted thereto is secured to the rod 6 by means of a securing screw 7. By the rotation of the cam 12, the to-be-tapered end portion 4*a* of the bundled fibers 4 descends at a predetermined velocity to be immersed in and ascends at a predetermined velocity to be withdrawn from the etching liquid 1 given supersonic vibration by the supersonic vibrator 3, the descension and ascension being repeated as required.

The descending and ascending velocities of the bundled fibers 4 may be adjusted by varying the rotation velocity of the cam 12 and using such a cam having a different shape whereby the end portion of the fibers may be tapered to form a desired shape, The synthetic fibers 4 may preferably be those obtained by molding a polyamide resin, a polyester resin, a polyacrylic resin or the like into its fibers having a diameter of 0.03–0.2 mm. For example, the preferable etching liquid 1 may be a solution of calcium chloride (50 parts by weight for example) and m-cresol (60 parts by weight for example) in methanol (100 parts by weight for example) in a case where polyamide fibers are to be tapered, may be a solution of sodium hydroxide in a case where polyester fibers are to be tapered and may be dimethylformamide in a case where polyacrylic fibers are to be tapered.

The bundled synthetic fibers 4 tapered at their end portion in the tapering apparatus of FIG. 1 are transferred to the washing tank 15 of FIG. 2 for their immersion in the washing liquid 14. The washing liquid 14 is a liquid which does not etch or dissolve the bundled fibers 4 end washes away the etching liquid carried by the etched fibers, and it may preferably be methanol for example. In the washing operation, the washing liquid 14 is given supersonic vibration by the supersonic vibrator 3 provided at the bottom of the washing tank 15.

Preferable combinations of the synthetic fibers, etching liquid and washing liquid used in this invention are shown in the following Table.

TABLE

| Combination | Synthetic fibers | Etching liquid | Washing liquid |
|---|---|---|---|
| 1 | Polyamide fibers (612 Nylon) | Solution of $CaCl_2$ and m-cresol in methanol | Low-concentrated etching liquid → methanol → water |
| 2 | Polyamide Fibers (66 Nylon) | Solution of $CaCl_2$ in methanol | Low-concentrated etching liquid → methanol → water |
| 3 | Polyester fibers | Hot phenol, hot NaOH solution, m-cresol or a mixture thereof | Low-con, weak acid (acetic acid for example) → water |
| 4 | Polyacrylic fibers | Hot dimethylforamide, hot dimethylsulfoxide or a mixture thereof | Low-con. (or ambient temp.) etching liquid → MEK → water |
| 5 | Polyvinyl alcohol fibers | Hot pyridine or hot phenol | Low-con. (or ambient temp.) etching liquid → MEK → water |
| 6 | Polyvinyl chloride fibers | Hot cyclohexanon, hot dioxane or a mixture of acetone and $CS_2$ | Etching liquid (ambient temp.) → acetone → methanol → water |
| 7 | Polyurethane fibers | Phenol or chloral hydrate | Phenol (ambient temp.) → methanol → water |

Remarks :

(1) In each of combinations 1–7, the etching liquid contained in the low-conc. etching liquid as a washing liquid is the same as that used for etching the synthetic fibers.

(2) Washing may be effected with methanol or water alone depending on the kind of the etching liquid used, or with methanol and then water. However, it may preferably be effected firstly with a low-conc. etching liquid, secondly with methanol and lastly with water.

Figure 3:
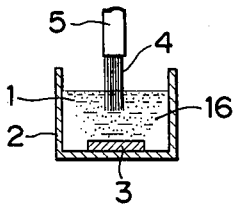
FIG. 3 is a diagrammatic view of an embodiment of an etching and abrading apparatus according to this invention.
Figure 4:
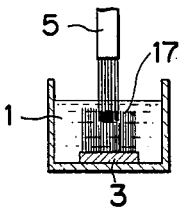
FIG. 4 is a diagrammatic view of another embodiment of an etching and abrading apparatus according to this invention.

In the second aspect of this invention, an abrading means may additionally be used as is seen from FIGS. 3 and 4. The upper portion of the tapering apparatus of FIG. 3 is omitted since it is substantially the same as that of the tapering apparatus of FIG. 1. Thus, the apparatus of FIG. 3 is different from that of FIG. 1 only in that the etching liquid 1 used in the former apparatus has abrasive particles 16 suspended therein and the bundled fibers 4 are slidably frictionized on the surface along their length with the abrasive particles 16 when the fibers 4 move up and down thereby to promote the tapering effect on the fibers. The abrasive particles may preferably be particulate calcium carbonate, glass microbeads, glass microbaloons (fine, hollow glass balls), particulate boron carbide, metal microbeads or metal microbaloons for example.

Figure 5:
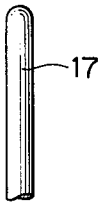
FIG. 5 is a view of a component, in magnified form, of the abrading means of the apparatus of FIG. 4.

The tapering apparatus of FIG. 4 is substantially the same as that of FIG. 3 except that the abrasive brush 17 is substituted for the abrasive particles 16. In the apparatus of FIG. 4, the abrasive brush 17 is provided within the etching liquid 1 and the end portion 4a of the fibers to be tapered is inserted into and withdrawn from the brush. The abrasive brush 17 consists of many slender rods (such as slender stainless steel, brass or glass rods) the lower ends of which are secured to a support. As is indicated in FIG. 5, the top end of the slender rods is rounded so that the free top end of the fibers does not make a head-on collision with that of the slender rods. By making the end portion 4a of the fibers go up and down in this manner, is not only etched by the etching liquid 1 but also slidably frictionized with the abrasive brush 17 thereby to increase the tapering effect. The abrasive brush may preferably be composed of, for example, slender stainless steel rods the lower end of which is secured to a support, and the diameter of the rods and the space therebetween may be selected depending on the kind and size of the fibers to be tapered. The fibers so tapered are then washed in the same manner as mentioned with respect to FIG. 2.

Figure 6:
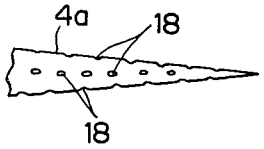
FIG. 6 is a view of the cavities formed on the surface of synthetic fibers by the action of supersonic vibration.

The end portion 4a of the fibers forms thereon minute cavities 18 by the cavitation caused by immersing said end portion in the etching liquid while giving supersonic vibration thereto as shown, in magnified form, in FIG. 6. Due to the cavities 18 formed on the tapered bundled fibers so obtained, the fibers have the secondary advantage in that they exhibit increased receptivity for a coating liquid, toilet powder or the like when used as a dressing brush or the like.

The advantages obtained by the practice of this invention are as follows.

(1) The time for etching (including abrading) and the time for washing are remarkably shortened.

(2) There are obtained the tapered bundled fibers having a satisfactory tapered end portion.

(3) The shape of taper to be obtained may optionally be adjusted.

(4) There is obtained a cavitation effect due to supersonic vibration.

What is claimed is:

1. A process for tapering synthetic fibers at the end portion comprising the steps of:

inserting the end portions of synthetic fibers at a predetermined velocity into an etching liquid capable of etching or dissolving the fibers while effecting supersonic vibration to the etching liquid, withdrawing the synthetic fibers at a predetermined velocity from the etching liquid while effecting supersonic vibration thereto, the insertion and withdrawal being alternately repeated to taper the fibers at said end portions, and then immersing the thus tapered synthetic fibers in a washing liquid while effecting supersonic vibration thereto to wash said tapered fibers.

2. A process according to claim 1, wherein the etching liquid has abrasive particles suspended therein thereby to promote the tapering of the synthetic fibers.

3. A process according to claim 1, wherein the etching liquid is provided therein with an abrasive brush thereby to promote the tapering of the synthetic fibers.

4. A process according to claim 1, 2 or 3, wherein the synthetic fibers are polyamide fibers, polyester fibers, polyacrylic fibers, polyvinyl fibers, polyvinyl chloride fibers or polyurethane fibers.

5. A process according to claim 1, 2 or 3, wherein the etching liquid is a solution of calcium chloride and m-cresol in methanol in the case where the synthetic fibers are polyamide fibers.

6. A process according to claim 1, 2 or 3, wherein the etching liquid is a solution of sodium hydroxide in the case where the synthetic fibers are polyester fibers.

7. A process according to claim 1, 2 or 3, wherein the etching liquid is dimethylformamide in the case where the synthetic fibers are polyacrylic fibers.

8. A process according to claim 1, 2 or 3, wherein the etching liquid is hot pyridine or hot phenol in the case where the synthetic fibers are polyvinyl alcohol fibers.

9. A process according to claim 1, 2 or 3 wherein the etching liquid is hot cyclohexanone, hot dioxane or the mixture of acetone and carbon disulphide in a case where the synthetic fibers are polyvinyl chloride fibers.

10. A process according to claim 1, 2 or 3, wherein the etching liquid is phenol or chloral hydrate in a case where the synthetic fibers are polyurethane fibers.

11. A process according to claim 1, 2 or 3, wherein the washing liquid is methanol or water alone, or methanol and water in separate and successive use.

12. A process according to claim 2, wherein the abrasive particles are particulate calcium carbonate, glass microbeads, glass microbaloons, boron carbide, metal microbeads or metal microbaloons.

13. A process according to claim 3, wherein the abrasive brush is one consisting of slender stainless steel, brass or glass rods the lower end of which is secured to a support.

14. A process for tapering synthetic fibers at the end portions thereof comprising the steps of:

inserting the end portions of synthetic fibers into an etching liquid capable of etching or dissolving the fibers while effecting supersonic vibration of the etching liquid, withdrawing the synthetic fibers from the etching liquid while effecting supersonic vibration of the etching liquid, the insertion and withdrawal being alternately repeated to taper the fibers at said end portions, said supersonic vibration of said etching liquid promoting said etching and dissolving of said fibers and diffusing the portion of the etching liquid in which the dissolved fibers are highly concentrated, and immersing the thus tapered synthetic fibers in a washing liquid to effect washing thereof.

15. A process according to claim 1 comprising effecting said supersonic vibration of said etching liquid to promote etching of said fibers.

16. A process according to claim 1 comprising effecting said supersonic vibration of said etching liquid to promote dissolution of said fibers.

17. A process according to claim 1 comprising effecting said supersonic vibration of said etching liquid to diffuse the portion of the etching liquid in which the dissolved fibers are highly concentrated.

18. A process according to claim 1 comprising effecting said supersonic vibration of said etching liquid to inhibit the bending tendency of said fibers.

19. A process according to claim 1 comprising effecting said supersonic vibration of said etching liquid to facilitate formation of minute cavities in said fibers.

20. A process according to claim 1 comprising adjusting the characteristics of the taper on said synthetic fibers by adjusting the velocity of the insertion and withdrawal of said fibers into and from said etching liquid.

21. A process according to claim 1 wherein said supersonic vibration imparted to said etching liquid is generated at a frequency of from 10 to 50 KHz.

* * * * *